US008435089B2

(12) United States Patent
Gaudin

(10) Patent No.: US 8,435,089 B2
(45) Date of Patent: May 7, 2013

(54) MARINE ENGINE ASSEMBLY INCLUDING A POD MOUNTABLE UNDER A SHIP'S HULL

(75) Inventor: Christian Gaudin, Asniéres sur Oise (FR)

(73) Assignee: Alstom, Levallois-Perret (FR)

( * ) Notice: Subject to any disclaimer, the term of this patent is extended or adjusted under 35 U.S.C. 154(b) by 0 days.

(21) Appl. No.: 11/587,863

(22) PCT Filed: Apr. 26, 2005

(86) PCT No.: PCT/FR2005/050280

§ 371 (c)(1),
(2), (4) Date: Jul. 26, 2007

(87) PCT Pub. No.: WO2005/110840

PCT Pub. Date: Nov. 24, 2005

(65) Prior Publication Data

US 2008/0194155 A1 Aug. 14, 2008

(30) Foreign Application Priority Data

Apr. 30, 2004 (FR) ..... 04 50842

(51) Int. Cl.
*B63H 5/15* (2006.01)

(52) U.S. Cl.
USPC ..... 440/67

(58) Field of Classification Search ..... 440/66, 440/67; 416/179, 244 R, 244 A, 247 A
See application file for complete search history.

(56) References Cited

U.S. PATENT DOCUMENTS

| | | | | |
|---|---|---|---|---|
| 803,671 | A * | 11/1905 | Curtis | 440/66 |
| 3,044,556 | A * | 7/1962 | Jefferson | 416/237 |
| 3,179,081 | A * | 4/1965 | Backhaus et al. | 440/5 |
| 3,389,558 | A * | 6/1968 | Hall | 60/221 |
| 4,427,393 | A | 1/1984 | May | |
| 4,600,394 | A | 7/1986 | Dritz | |

(Continued)

FOREIGN PATENT DOCUMENTS

| | | | |
|---|---|---|---|
| DE | 101 58 320 | A | 6/2003 |
| EP | 1 270 404 | A2 | 1/2003 |
| WO | WO 8912572 | A1 * | 12/1989 |
| WO | WO 9914113 | A | 3/1999 |

OTHER PUBLICATIONS

International Search Report dated Jul. 11, 2005 (WO 991411 A) (PCT/FR/2005/050280).

(Continued)

*Primary Examiner* — Edwin Swinehart
(74) *Attorney, Agent, or Firm* — Abelman, Frayne & Schwab

(57) ABSTRACT

The marine propulsion set (1, 1', 1") comprises: at least one pod (2) that is mechanically connected to a support strut (3, 3', 3"); a propeller (4) that is situated at the aft end of the pod and that has at least two blades (14); and an arrangement of at least three flow-directing fins (50 to 55, 3'A) that are fastened to the pod (2). This arrangement of fins forms a ring (5) that is substantially perpendicular to the longitudinal axis (X) of the pod (2), said ring lying within a zone (Zx) that is situated between the central portion of said support strut (3, 3', 3") and the propeller. The propulsion set further comprises a nozzle (6) that surrounds, at least in part, the propeller (4) and said ring (5). Each of said blades (14) presents an end with an edge (7) coming flush with the inside wall of the nozzle (6) so that the propeller (4) constitutes the rotor of a screw pump.

11 Claims, 2 Drawing Sheets

U.S. PATENT DOCUMENTS

| | | | | |
|---|---|---|---|---|
| 4,637,801 | A * | 1/1987 | Schultz | 440/67 |
| 5,101,128 | A | 3/1992 | Veronesi et al. | |
| 5,597,245 | A | 1/1997 | Meyerhoff | |
| 5,722,866 | A | 3/1998 | Brandt | |
| 6,059,618 | A * | 5/2000 | Purnell et al. | 440/38 |
| 6,062,925 | A | 5/2000 | Salmi et al. | |
| 6,244,912 | B1 * | 6/2001 | Quadrini et al. | 440/6 |
| 6,371,726 | B1 | 4/2002 | Jonsson et al. | |
| 2002/0127925 | A1 * | 9/2002 | Burg | 440/38 |

OTHER PUBLICATIONS

International Search Report dated Dec. 7, 1998 (PCT/FI98/00725); Alekseyev Yuriy Nikolaevich, et al.
Chinese Office Action, Dec. 7, 2007, Alstom, in Chinese.
Chinese Office Action, Dec. 7, 2007, Alstom, English Translation.

* cited by examiner

MARINE ENGINE ASSEMBLY INCLUDING A POD MOUNTABLE UNDER A SHIP'S HULL

I. CROSS-REFERENCE TO RELATED APPLICATIONS

Priority is claimed under 35 U.S.C. §119, 120 and/or 365 on International Application No. PCT/FR 2005/050280 having International filing date 26 Apr. 2005 and FR 0450842 with priority date 30 Apr. 2004.

II. BACKGROUND OF THE INVENTION

A. Field of the Invention

The invention relates to a marine propulsion set with a pod installable under the hull of a ship.

B. Description of Related Art

Generally, conventional marine propulsion sets of the pivotally mounted pod type are not designed to work in the wake of the ship and indeed have a support strut that is long enough for its propeller to be situated outside the boundary layer of the wake. Such conventional pivotally mounted pod type propulsion sets are generally voluminous at least due to the large amount of space necessary between the hull of the ship and the propeller of the set. Furthermore, such propulsion sets are generally subjected to vibration and cavitation phenomena, cavitation being particularly present when the propulsion set is slewing. Cavitation is a phenomenon that releases explosive bubbles of water vapor at the ends of the blades of a propeller. In marine hydrodynamics, cavitation degrades the performance of propulsive systems, induces vibration, causes erosion of the rotary portions, and radiates noise that degrades the acoustic discreetness of the ship.

From certain prior art documents and in particular from Patent Document EP 1 270 404, it is known that there exists a propulsion set as defined above in which a propeller of an auxiliary propulsion unit of the compact pivotally mounted pod type is situated at the aft end of the pod. Furthermore, that propeller is designed to work in the wake of another propeller or "main screw" which is mounted on a fixed shaft disposed under the hull of the ship. The main screw is designed to deliver the majority of the propulsive power, e.g. by means of a diesel engine installed in the ship, whereas the auxiliary propeller or "screw" of the propulsion pod is designed to deliver either additional propulsive power or directional power if the propulsion pod is pivoted for steering the ship. In the versions with an arrangement of fins around the pod, that arrangement of fins is situated either on the forward portion of the pod or further aft, but no further aft than the central portion of the support strut. The purpose of the fins is to improve the propulsive efficiency by recovering the axial component of the rotary energy from the vortex generated by the main screw, and they must therefore be relatively close to the main screw. It is possible to make provision for the fins to be inclined to a small extent relative to the axis of the pod in order to increase the energy recovery.

Although such a pivotally mounted propulsion pod is particularly compact, the overall propulsion set including the main screw remains voluminous and requires a relatively deep draught under the hull as do conventional pivotally mounted pod type propulsion sets.

III. OBJECTS AND SUMMARY OF THE INVENTION

The invention relates to a marine propulsion set comprising:

- at least one pod that is mechanically connected to a support strut designed to be mounted under the hull of a ship;
- a propeller that is situated at the aft end of the pod, that has at least two blades, and that is constrained to rotate with a transmission shaft connected to a motor or an engine; and
- an arrangement of at least three flow-directing fins that are fastened to the pod, said arrangement forming a ring that is substantially perpendicular to the longitudinal axis of the pod.

More particularly, the invention relates to a propulsion set of the compact pivotally mounted pod type in which the support strut is designed to be pivotally mounted under the hull of the ship. The "forward" or "front" and "aft" or "rear" portions of the pod are defined relative to the bow and to the stern of the ship, i.e. the forward or front portion of the pod points towards the bow of the ship, at least when the propulsion set is propelling the ship forwards. In most pivotally mounted pod type propulsion sets, such as, for example, the propulsion set described in Patent Document W099/14113, the propeller is situated at the forward end of the pod, unlike in a propulsion set of the invention.

An object of the invention is to reduce the draught under the hull of a ship having at least one propulsion unit with a propeller mounted on a pod, relative to the draughts of prior art solutions. For this purpose, an object of the invention is to procure a propulsion set that can be brought closer to the hull, and more particularly a set of the compact pivotally mounted pod type. In order to improve the vertical compactness of the propulsion set, an object of the invention is to reduce the height of the support strut of the pod so as to bring the propeller as close as possible to the hull, while at the same time avoiding cavitation phenomena. Finally, an object of the invention is also to increase the efficiency of the propulsion set and to reduce the costs thereof, at least as regards the drive portion of said set.

In order to achieve these objectives, the invention proposes a compact propulsion set that operates on the principle of an axial-flow pump or screw pump, i.e. it propels the ship by forcing water through a nozzle. The screw pump is inspired by aircraft jet engines, in particular as regards controlling the incoming flow, and it uses a system acting on the back-flow of water in order to avoid cavitation phenomena. A screw pump works in liquid flow rate, whereas a conventional propeller works in liquid thrust. It should be noted that, per se, the principle of propulsion by screw pump has, for a long time, been applied in submarine propulsion systems, and that positioning a screw pump in the wake of a submarine makes it possible to obtain good efficiency while also reducing acoustic interference. It is also known, in particular from Patent Document U.S. Pat. No. 4,600,394 that there exist applications of screw pump technology for marine outboard motors and inboard engines.

Naturally, it is not sufficient merely to surround a conventional propeller with a nozzle-shaped piece of streamlined ducting in order to obtain a screw pump. It is well known from the state of the art, e.g. from Patent Document U.S 6 062 925 that the propulsion force of a propeller mounted on a pod can be increased at low speed by installing a nozzle-shaped piece of streamlined ducting around the propeller. However, such an installation does not make it possible to obtain a screw pump because, in particular, the shape of the blades in a screw pump is specific to that technology and differs significantly from the shapes used for conventional propellers.

Finally, it is known from Patent Document DE 101 58320 that there exists a pivotally mounted marine pod type propulsion set that implements a screw pump whose rotor propeller or "impeller" is arranged around the stator of the electric motor of the pump. The motor is thus completely surrounded by the nozzle of the pump, which nozzle is attached to the support strut of the pivotally mounted pod set. With that architecture, the diameter of the rotor propeller necessarily increases with increasing motor size and thus with increasing motor power. For a high motor power motor (e.g. about 10 megawatts (MW)), the resulting dimensioning for the rotor propeller requires the nozzle diameter to be relatively large in order to provide a sectional area that is large enough for the flow rate of water through the pump.

That architecture results in hydrodynamic drag that is relatively high for the propulsion set and thus propulsive efficiency that is very poor, which is a major drawback. In addition, it is definitely more difficult to cool the electric motor, in particular when the motor is a high-power motor, than in a conventional pivotally mounted pod set in which the motor is installed inside the pod and is remote from the propeller. In a conventional pivotally mounted pod set it is known that the motor can be cooled by a forced circulation of air brought into the pod from the ship via the inside of the support strut.

Therefore, although such a screw pump pivotally mounted pod set makes it possible to achieve certain objects of the present invention such as, in particular, eliminating cavitation phenomena, it does not make it possible to obtain a propulsion set and in particular a high-power set that is relatively compact in diameter and that has propulsive efficiency at least equal to the propulsive efficiency of a conventional pivotally mounted pod set of the same power. An object of the present invention is also to remedy the drawbacks of such a screw pump pivotally mounted pod set architecture.

To these ends, the invention provides a propulsion set as defined in the introduction above, characterized in that it further comprises a nozzle that surrounds, at least in part, the propeller and said ring of fins, in that each of said blades presents an end with an edge coming flush with the inside wall of the nozzle so that the propeller constitutes the rotor of a screw pump, and in that said ring of fins lies within a zone that is situated between the central portion of said support strut and the propeller.

The arrangement formed by the fins and the nozzle constitutes the stator of the screw pump. A screw pump generally rotates 50% to 100% faster than a conventional propeller of equivalent power, which makes it possible to reduce by 50% to 100% the torque of the drive motor or engine for the propeller and thus allows the diameter of the motor or engine to be reduced by from 20% to 40% (for an electric motor) relative to a conventional pivotally mounted pod set. In a propulsion set of the invention, the reduction in the diameter of the motor makes it possible to reduce the diameter of the pod and the weight of the set for embodiments in which the motor is housed inside the pod. The reduction in the diameter of the pod makes it possible to reduce the hydrodynamic drag of the propulsion set and thus to increase its propulsive efficiency.

In addition, the motor and most of the volume of the pod are situated upstream from the screw pump relative to the flow of water. This makes it possible for the propeller to have a hub that is relatively compact, and a sectional area can thus be obtained for the propeller of the pump that is sufficient without it being necessary to degrade hydrodynamic flow by increasing the diameter of the nozzle to an exaggerated extent. Typically, with an electric motor having power greater than 10 MW housed inside the pod, a propulsion set of the invention can be obtained with a nozzle whose inside diameter, i.e. substantially the diameter of the propeller, is about twice the diameter of the pod. This makes it possible to have a sectional area for the propeller that is sufficient to guarantee a good flow-rate of water through the pump, while also having hydrodynamic drag for the propulsion set that is relatively low compared with the apparatus of Patent DE 101 58320.

Finally, the fact that it is possible for the screw pump to work in the ship's wake without any cavitation phenomenon makes it possible to reduce the height of the support strut, thereby also contributing to making the set more compact. The screw pump can be brought closer to the hull of the ship because it does not transmit any pressure pulses generating vibration on board the ship. This can be explained firstly by the fact that the flow of water is organized by the stator of the screw pump, which makes it possible for the speed of arrival of the water at the rotor to be made uniform in the chamber that separates the rotor from the stator. The residual pressure pulses generated by the screw pump are therefore relatively small. In addition, said residual pulses are attenuated at the nozzle of the pump, and their repercussion on the hull of the ship is sufficiently low not to generate vibration on board the ship.

The draught under the hull can then be smaller than with a conventional pivotally mounted pod set, which makes it possible to have greater flexibility for designing stern shapes for a ship. In addition, the fact that the screw pump is placed inside the boundary layer of the ship's wake offers the advantage of increasing its propulsive efficiency relative to the propulsive efficiency procured with the screw pump disposed outside the boundary layer. Inside said boundary layer, the speed of the water at the inlet of the screw pump is reduced relative to said speed with a configuration in which the screw pump is disposed outside said layer, which increases the differential between the speeds respectively at the outlet of the nozzle and at the inlet of the pump, thereby increasing the thrust generated by the rotor of the pump. It should be noted that the thickness of the boundary layer increases with increasing ship speed and ship size. At the cruising speed of the ship, the magnitude of the wake is greater, and its propulsive efficiency is thus increased relative to its propulsive efficiency at lower speeds.

In a compact propulsion set of the invention, the fins constitute flow directors for the screw pump. The ring-shaped arrangement of fins lies within a zone situated longitudinally aft of the central portion of the support strut, in order to be sufficiently close to the propeller. In the present application, the central portion of a support strut is defined as being that portion which includes a cavity communicating with the inside of the hull of the ship.

A propulsion set of the invention is particularly suitable for a ship in which the support strut of the pod is designed to be mounted to pivot under the hull of the ship so that said propulsion set is of the pivotally mounted pod type. In a ship equipped with a plurality of propulsion sets of the invention, it is possible to have at least one set of the pivotally mounted pod type that is mounted to pivot through 360° and that is situated at the stern of the ship in the ship's wake in order to steer the ship in the manner of a rudder, and optionally in order to provide a braking thrust without reversing the direction of the rotation of the rotor of said set.

IV. BRIEF DESCRIPTION OF THE DRAWINGS

The invention, its characteristics, and its advantages appear more clearly from the following description given with reference to the following figures, in which.

V. DETAILED DESCRIPTION OF THE PREFERRED EMBODIMENTS

Figure 1:
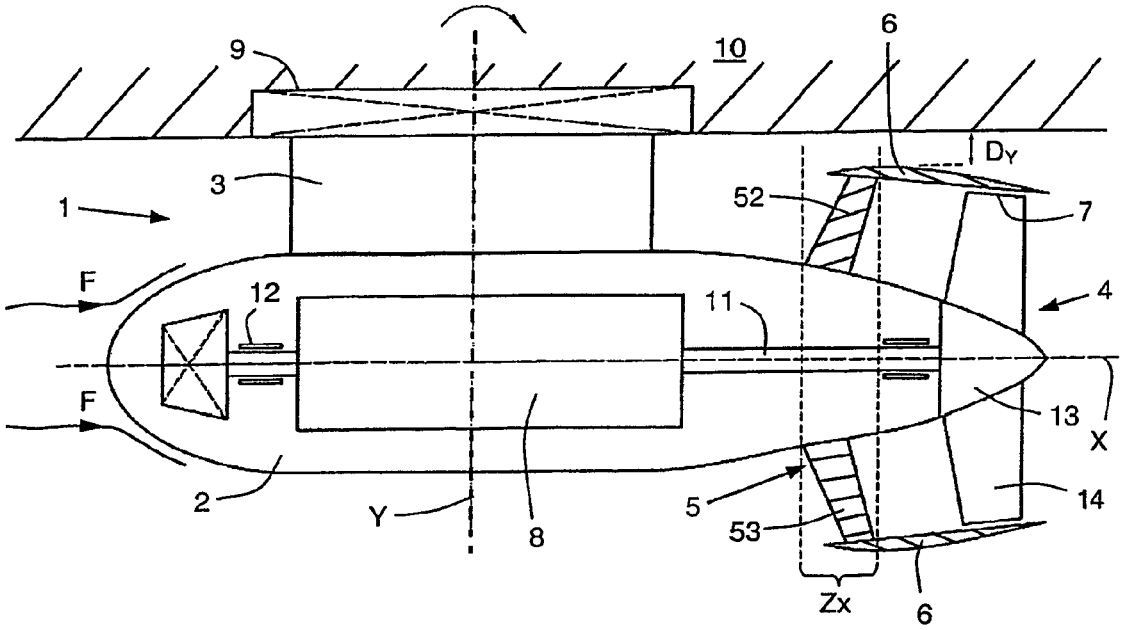
FIG. 1 is a diagrammatic section view of a propulsion set of the invention of the pivotally mounted pod type, on a vertical plane containing the longitudinal axis of the pod.

FIG. 1 shows a propulsion set 1 of the invention seen from the side in longitudinal section on the plane formed by the longitudinal axis X of the pod 2 and by the pivot axis 6 of the set 1. Said set 1 is installed under the hull 10 of a ship, the pod 2 being conventionally connected to a support strut 3 mounted to pivot on a watertight bearing 9 passing through the hull of the ship. In the preferred embodiment shown in the figure, the pod 2 is dimensioned to contain an electric motor 8 whose rotor (not shown) is constrained to rotate with the drive shaft 11 of the propeller 4. The shaft 11 is held on the axis X by means of bearings 12. In known manner, the pod and the support strut 3 are streamlined so as to optimize the hydrodynamic flow of the flow of water represented by the arrows F. FIG. 1 includes a fragmentary structure 10 representing the hull of a conventional ship which includes but does not show fore and aft ends and a central longitudinal axis of such ship.

As is known from the state of the art, another embodiment can also be imagined in which the motor is disposed inside the hull of the ship, an angled mechanical transmission system then being provided for transmitting the rotation of the motor to the drive shaft of the propeller. In addition, in a propulsion set of the invention, it is not essential for the strut that supports the pod to be mounted to pivot relative to the hull of the ship. In an embodiment with a fixed support strut, it is possible to imagine having at least one other fixed link strut for connecting the nozzle directly to the hull and for reinforcing the mechanical coupling between the propulsion set and the hull. Said other strut can be of small size because the nozzle is preferably very close to the hull. The ship can then be steered by specific directional means dissociated from the propulsion set, or indeed using the principle shown in Patent EP 1 270 404 which implements an angularly positionable auxiliary propulsion set of the compact pivotally mounted pod type.

In the embodiment shown in FIG. 1, the watertight bearing 9 is designed to enable the support strut 3 to pivot in order to act as a rudder for steering the ship. The support strut 3 can be mounted to pivot in particular through up to 180° relative to the normal propulsion position shown in the figure in order to reach a "braking" mode propulsion position with thrust opposing the forward movement of the ship. However, such a "braking" mode can also be obtained with a support strut 3 that does not pivot or that pivots to a small extent only, by a substantial astern thrust by reversing the direction of rotation of the propeller 4.

In order to implement the screw pump, the propulsion set or propulsion assembly includes an arrangement of flow-directing fins such as 52 and 53 which are fastened to the pod 2, said arrangement forming or defining a ring or cylindrical zone 5 that is substantially perpendicular to the axis X of the pod and that lies within a zone Zx situated longitudinally between the support strut 3 and the propeller 4. In general, in a propulsion set of the invention, said zone Zx lies between the central portion of the support strut and the propeller, as explained below with reference to FIG. 3. Preferably, the ring 5 is formed of at least five fins, and the propeller 4 is provided with at least three blades 14. Said flow-directing fins must be disposed close enough to the propeller in order to direct the water flow lines arriving on the propeller in appropriate directions. They are not necessarily identical.

In addition, a nozzle 6 surrounds the propeller 4 and the ring 5 of the fins. As described below with reference to FIG. 2, the inlet profile of the nozzle 6 and the angular-positioning of each fin are preferably adapted to the wake map of the ship at its cruising speed. It should be noted that the nozzle participates in the total thrust by means of its own lift. The propeller has a hub 13 which is constrained to rotate with the shaft 11, and on which the blades 14 are mounted. Each blade 14 has one end with an edge 7 flush with the inside wall of the nozzle. Thus, the ring 5 and the nozzle 6 constitute the stator of the screw pump, the propeller 4 constituting the rotor of the pump.

Advantageously, the nozzle has a cross-section that tapers gradually going aft, and has convergent or divergent shapes that are adapted as a function of the cruising speed designed for the ship, in order to increase propulsive efficiency. In addition, in conventional manner, the fins have inclined profiles so as to reduce their hydrodynamic resistance. As a result, as shown in FIG. 1, it is not necessary for the front portion of the nozzle to extend over the entire longitudinal zone Zx of positioning of the ring 5. The forward limit of said zone is represented by a dashed line at the same point along the axis X as the front ends of the fins. It is quite possible to imagine using fins that are even more streamlined thus to increase significantly the longitudinal depth of the zone Zx of positioning of the ring 5 of fins.

At least three flow-directing fins, and preferably all of the fins of the ring 5, are used to ensure that the nozzle 6 is fastened securely to the pod 2. The axis of symmetry of the nozzle substantially coincides with the longitudinal axis X of the pod, which makes it possible to have a small amount of clearance between the outer tip edges 7 of the ends of the blades 14 of the propeller and the inside wall of the nozzle. In the embodiment described with reference to FIG. 1, the blades 14 Are all identical, and the end edge 7 of a blade coming flush with the nozzle is defined by two sharp angles so as to maximize the curved length flush with the nozzle relative to the total length of the periphery of the blade. It is known that such an angular shape for the end edges of the blades is advantageous for screw pump technology. The pump rotor constituted by the propeller 4 has at least two blades 14. Simulations performed by computation have shown that it is not advantageous to have a rotor formed by a single, screw-shaped blade using the principle disclosed by U.S. Pat. No. 4 600 394.

Advantageously, the distance $D_y$ between the nozzle 6 of the screw pump and the hull 10 of the ship is defined so that the propeller 4 works optimally in the wake of the ship. It is advantageous to dispose the propulsion set in the wake of the ship while at the same time preferably avoiding the "viscous" wake that presents an excessively large reduction in the speed of the flow of the water relative to the ship. Advantageously, preference is given to positioning the propulsion set in that portion of the wake which present a mean reduction in speed of flow of about 15%. In addition to the advantage of enabling the height of the support strut 3 to be reduced, such positioning of the screw pump thus makes it possible to increase propulsive efficiency optimally relative to the propulsion efficiency procured with a positioning outside the boundary layer of the wake.

Figure 2:
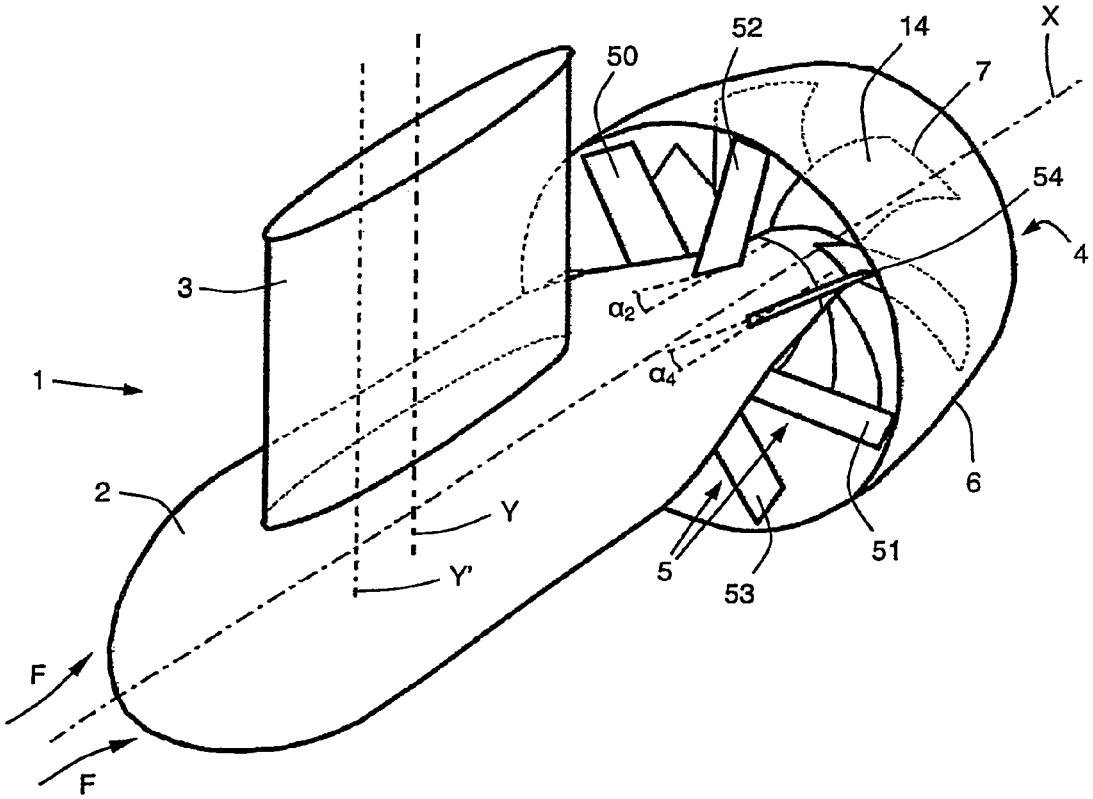
FIG. 2 is a diagrammatic perspective view of the propulsion set of FIG. 1.

In FIG. 2, the propulsion set 1 of the invention is seen in perspective so as to show more clearly the respective structures of the propeller 4 and of the ring 5 of flow-directing fins. In this example, the ring 5 has six fins 50 to 55 for directing the flow of water entering the screw pump so as to impart to said flow a rotation torque that is substantially equal to the rotation torque of the rotor but that turns in the opposite direction, the flow of water then being free of rotation energy at the outlet of the rotor, thereby offering the advantage of increasing the efficiency of the screw pump. The fin 55 is hidden by the aft portion of the pod 2 in this view.

Each fin presents an approximately plane surface that has a determined angular position relative to the axis X of the pod. The angular positioning angle $\alpha_n$ of a fin is defined as the angle formed between the plane of the fin and the axis X. Each fin, such as 52 or 54 is fastened to the aft portion of the pod at an angular positioning angle that is specific to it, such as $\alpha_2$ or $\alpha_4$ in FIG. 2 and $\alpha'$ in FIG. 4. Preferably, each angle $\alpha_n$ is determined on the basis of the wake map of the ship at its cruising speed, and each angle $\alpha_n$ is thus adapted as a function of the incoming flow of water so as to direct the arrival of the water onto the rotor, thereby avoiding cavitation phenomena. The influence of the support strut 3 on the streams of water entering the nozzle is taken into account, in particular for determining the angle of orientation $\alpha_2$ of the fin 52 that is situated aft of the strut 3. The inlet profile of the nozzle is also preferably determined on the basis of the wake map of the ship at its cruising speed.

In addition, by rotating faster than a conventional propeller, the rotor of the propulsion assembly of the invention develops a smaller amount of torque and thus the deflection of the flow in the stator must remain moderate in order to match said torque. Therefore, the angular positioning angles of the fins are relatively small, and thus it is possible for water to pass through in the reverse direction. Each angular positioning angle an can be determined, for example, in the range 3° to 15°, which makes it possible to obtain sufficient astern thrust by reversing the direction of rotation of the propeller 4, the flow of water generated by the propeller then not being significantly disturbed by the fins. In addition, a rotor in which each of the blades has a straight generator line can accommodate the full nominal toque when the rotor is rotating in the reverse direction, unlike a conventional propeller of the skew type, as described, for example, in Patent Document U.S. Pat. No. 6,371,726. This is made possible by the mechanical stresses being well distributed over the surfaces of the blades, thereby improving the braking thrust. It is to be understood that an object having a straight generator line is formed by a two-dimensional outline being subjected to a translation along a straight line that intersects the plane of the outline.

The blades 14 of the propeller 4 are shown with a slight twist as can be seen in FIG. 2, and they have slightly curved generator lines, but naturally, blades having generator lines that are strictly straight can be preferred in order to increase the braking thrust further. It is also visible that the end edge 7 of a blade 14 that comes flush with the inside wall of the nozzle 6 is curved. In addition, as in FIG. 1, it can be seen that the shape of the nozzle converges slightly going aft. Finally, it can be noted that the pivot axis Y about which the propulsion set 1 is mounted to pivot does not necessarily correspond to the axis of symmetry of the support strut 3, and can, for example, be offset forwards as in the position shown by the axis Y' in FIG. 2.

The simulations by computation that have been performed by the applicant have made it possible to establish a comparison between a conventional pivotally mounted pod type propulsion set with a propeller situated at the forward end of the pod and a propulsion set of the invention which is also of the pivotally mounted pod type with an electric motor received inside the pod. By way of example, such a propulsion set of the invention has a pod 2 having a diameter of about two meters and a nozzle 6 having a diameter of about four meters, with a motor power of about 13 MW. The ring 5 has seven flow-directing fins, and the rotor propeller 4 has five blades 14. The number of revolutions per minute (r.p.m.) of the rotor is greater than two hundred. With the same motor power, the invention makes it possible to reduce the weight of the motor by more than 50%, and to reduce the diameter of the propeller and the diameter of the pod by more than 25%. In addition, the reduction obtained for the draught is about 3 meters, and the efficiency of the screw pump pivotally mounted pod set is more than 5% greater than the efficiency of the conventional pivotally mounted pod assembly. It thus appears that, overall, the advantages procured by the invention over known state-of-the-art conventional marine pivotally mounted pod sets and marine screw pump propulsion units are considerable.

Figure 3:
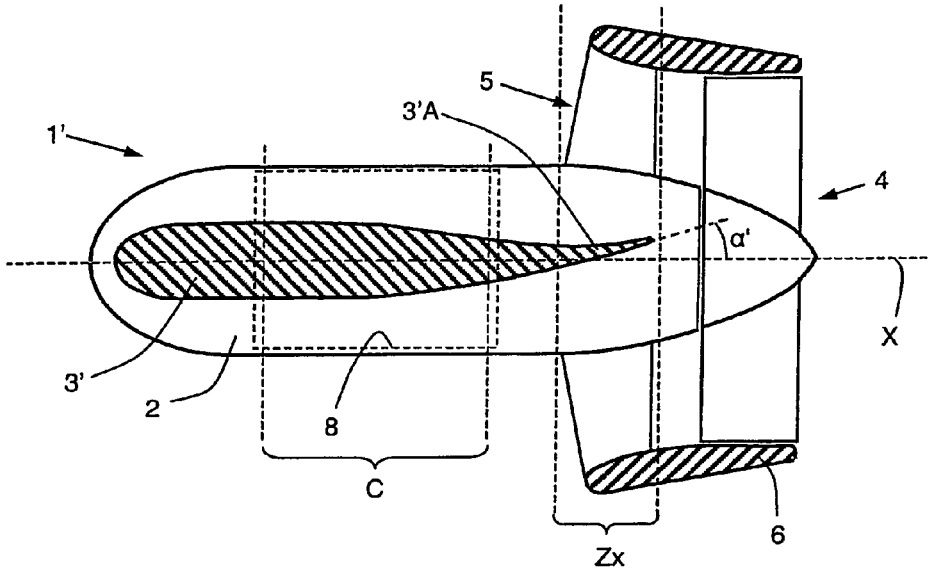
FIG. 3 is a diagrammatic plan view of another propulsion set of the invention, in which the aft end of the support strut constitutes a flow-directing fin.

FIG. 3 is a diagrammatic plan view of another propulsion set 1' of the invention. The pod 2 and the screw pump are shown in section on a horizontal plane containing the horizontal axis X of the pod, while the support strut 3' is shown in section on another horizontal plane situated above the pod. The aft end portion 3'A of the support strut 3' constitutes a flow-directing fin, this portion presenting a substantially plane surface that has a determined angular positioning angle $\alpha'$ relative to the axis X of the pod. The ring 5 has at least two flow-directing fins that are similar to the fins 50 to 55 shown in FIGS. 1 and 2, and thus has a particular fin constituted by the portion 3'A.

In general, in a propulsion set of the invention, the zone Zx in which the ring of fins lies, perpendicularly to the longitudinal axis X of the pod, is situated between the central portion of the support strut and the propeller, said central portion being provided with a cavity that is provided in the strut and that communicates with the inside of the ship. In the embodiment corresponding to FIG. 3, the central portion C of the support strut 3' is situated substantially above the motor 8 installed inside the pod, and a forced circulation of air between the pod and the inside the ship is provided in said central portion with a flow rate that is sufficient to cool the motor.

The aft end portion 3'A of the support strut can be arranged to extend upwards to come flush with the hull of the ship by passing above the top of the nozzle 6, it then being necessary to provide a setback in said portion 3'A in order to enable the top of the nozzle to be inserted with it being held by the portion 3'A. This embodiment makes it possible, to a certain extent, to reduce the hydrodynamic drag of the propulsion set compared with the embodiment shown in FIGS. 1 and 2.

Figure 4:
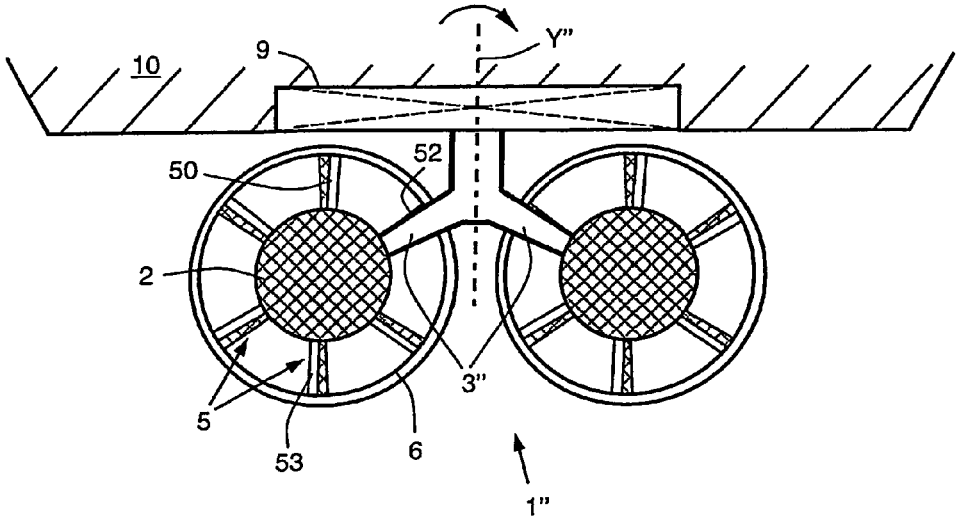
FIG. 4 is a diagrammatic front view of another propulsion set of the invention and of the pivotally mounted pod type, comprising two identical propulsion units disposed side-by-side.

In FIG. 4, another propulsion set 1" of the invention is shown very diagrammatically and from the front, looking towards the stern of the ship. This set is of the pivotally mounted pod type, and comprises two identical or almost identical propulsion units disposed side-by-side. Each propulsion unit is, in this example, identical to the unit of the propulsion set 1 or 1' described above. The two propulsion units are mechanically connected to a single support strut 3" that is mounted to pivot under the hull 10 of the ship. Said support strut 3" is in the shape of star having three branches, and its pivot axis Y'" corresponds to the axis of the widest branch. The power of a propulsion set 1 or 1' as shown in FIGS. 1 to 3 can thus be almost doubled without having to develop a more powerful screw pump, and without having to increase the draught, while conserving the advantage of having only one watertight and pivotally mounted bearing 9 passing through the hull of the ship.

The invention claimed is:

1. A marine propulsion assembly operable as a screw pump that is mountable to a support strut which has fore and aft ends and extends downward from below the hull of a ship, said assembly comprising:

a- a pod shaped housing with fore and aft ends and a central longitudinal axis X, said hull having a lower side, said pod being pivotally mounted to said lower side of said hull about a pivot axis Y that extends upward from said pod through said hull and extends generally transverse of said central longitudinal axis X, b- a motor mounted within said housing, said motor having a transmission shaft extending in said aft end direction, said transmission shaft having an aft end, c- a propeller situated at the aft end of said housing and coupled to said aft end of said transmission shaft, said propeller having a hub part and at least two blades each having a near end fixed to said hub part each blade extending radially and having a remote tip edge, d- at least three flow-directing fins extending generally radially outward from said housing and terminating in an outer tip edge, each of said fins having fore and aft edges, said fins spaced apart circumferentially around said housing, said outer tip edges of said fins (i) defining a ring zone of axial length Zx, (ii) having a central longitudinal axis coaxial with said longitudinal axis X, and (iii) being situated axially between said support strut and said propeller, and e- a nozzle through which a water flow is forced by said propeller, said nozzle formed as a ring generally coaxial with said housing and having a fore part fixed to said outer tip edges of said flow-directing fins and an aft part extending axially in the aft direction where it surrounds and is adjacent said remote tip edges of said propeller blades, said propulsion assembly having no fins situated aft of said propeller and fixed to said nozzle or housing, whereby said propeller constitutes the rotor of a screw pump, where said propeller imparts a rotational torque to said water flow and said flow-directing fins impart to said water flow a rotational torque substantially equal but opposite to said rotational torque imparted by said propeller such that the flow of water is free of rotation energy at the outlet of the propeller.

2. A propulsion assembly according to claim 1, wherein said assembly has at least five of said flow-directing fins, and said nozzle is fastened to said pod via at least five of said fins, and said propeller has at least three of said blades.

3. A propulsion assembly according to claim 1, wherein each of said fins has a surface that is at least approximately plane and said surface has a predetermined angular positioning angle ($a_n$) relative to said axis X of said pod.

4. A propulsion assembly according to claim 3 wherein said predetermined angular positioning angle ($a_n$) of each of said fins lies in the range 3° to 15°.

5. A propulsion assembly according to claim 1 wherein said propeller is adapted to have a reversible direction of rotation so as to generate a braking thrust for braking the ship.

6. A propulsion assembly according to claim 1 wherein said aft end of said support strut forms one of said flow-directing fins of said ring.

7. A propulsion assembly according to claim 1, in which said support strut to which said pod is connected, is pivotable about an axis generally perpendicular to said axis X.

8. A ship having a propulsion assembly according to claim 1, in which said support strut to which said pod is connected, is pivotable about an axis generally perpendicular to said axis X.

9. A marine propulsion assembly operable as a screw pump that is mountable to a support strut which has fore and aft ends and extends downward from below the hull of a ship, said assembly comprising:

a- a pod shaped housing with fore and aft ends and a central longitudinal axis X, said hull having a lower side, said pod being pivotally mounted to said lower side of said hull about a pivot axis Y that extends upward from said pod through said hull and extends generally transverse of said central longitudinal axis X, b- a motor mounted within said housing, said motor having a transmission shaft extending in said aft end direction, said transmission shaft having an aft end, c- a propeller situated only at the aft end of said housing and coupled to said aft end of said transmission shaft, said propeller having a hub part and at least two blades each having a near end fixed to said hub part each blade extending radially and having a remote tip edge, d- at least three flow-directing fins extending generally radially outward from said housing and terminating in an outer tip edge, each of said fins having fore and aft edges, said fins spaced apart circumferentially around said housing, said outer tip edges of said fins (i) defining a ring zone of axial length Zx, (ii) having a central longitudinal axis coaxial with said housing axis X, and (iii) being situated axially between said support strut and said propeller, and e- a nozzle through which a water flow is forced by said propeller, said nozzle formed as a ring generally coaxial with said housing and having a fore part fixed to said outer tip edges of said flow-directing fins and an aft part extending axially in the aft direction where it surrounds and is adjacent said remote tip edges of said propeller blades, said propulsion assembly having no fins situated aft of said propeller and fixed to said nozzle or housing, whereby said propeller constitutes the rotor of a screw pump, where said propeller imparts a rotational torque to said water flow and said flow-directing fins impart to said water flow a rotational torque substantially equal but opposite to said rotational torque imparted by said propeller such that the flow of water is free of rotation energy at the outlet of the propeller.

10. A propulsion assembly according to claim 1 wherein said support strut has an elongated blade shape, is situated fore of said propeller and has an aft part that extends in the aft direction into said ring zone and serves as an additional flow-directing fin.

11. A marine propulsion assembly operable as a screw pump that is mountable to a support strut which has fore and aft ends and extends downward from below the hull of a ship, said assembly comprising:

a- a pod shaped housing with fore and aft ends and a central longitudinal axis X, said hull having a lower side, said pod being pivotally mounted to said lower side of said hull about a pivot axis Y that extends upward from said pod through said hull and extends generally transverse of said central longitudinal axis X, b- a motor mounted within said housing, said motor having a transmission shaft extending in said aft end direction, said transmission shaft having an aft end, c- a propeller situated at the aft end of said housing and coupled to said aft end of said transmission shaft, said propeller having a hub part and at least two blades each having a near end fixed to said hub part each blade extending radially and having a remote tip edge, d- at least three flow-directing fins extending generally radially outward from said housing and terminating in an outer tip edge, each of said fins having fore and aft edges, said fins spaced apart circumferentially around said housing, said outer tip edges of said fins (i) defining a ring zone of axial length Zx, (ii) having a central longitudinal axis coaxial with said longitudinal axis X, and (iii) being situated axially between said support strut and said propeller, and e- a nozzle through which a water flow is forced by said propeller, said nozzle formed as a ring generally coaxial with said housing and having a fore part fixed to said outer tip edges of said flow-directing fins and an aft part extending axially in the aft direction where it surrounds and is adjacent said remote tip edges of said propeller blades, said propulsion assembly having no fins situated aft of said propeller, whereby said propeller constitutes the rotor of a screw pump, where said propeller imparts a rotational torque to said water flow and said flow-directing fins impart to said water flow a rotational torque substantially equal but opposite to said rotational torque imparted by said propeller such that the flow of water is free of rotation energy at the outlet of the propeller.

* * * * *